United States Patent [19]

Erlich

[11] 4,015,769

[45] Apr. 5, 1977

[54] CIGARETTE BOX OR PACKAGE

[76] Inventor: Shlomo Erlich, 1740 Clement St., San Francisco, Calif. 94121

[22] Filed: Jan. 30, 1976

[21] Appl. No.: 653,788

[52] U.S. Cl. ..... 229/44 CB; 206/92

[51] Int. Cl.[2] ..... B65D 5/66

[58] Field of Search ..... 229/44 CB; 206/92, 94, 206/95

[56] References Cited

UNITED STATES PATENTS

| | | | |
|---|---|---|---|
| 2,041,548 | 5/1936 | Holtzman | 206/92 |
| 2,944,726 | 7/1960 | McCauley | 229/44 CB |
| 2,956,722 | 10/1960 | Prussack | 229/44 CB |
| 2,958,418 | 11/1960 | O'Gorman | 229/44 CB |
| 3,011,630 | 12/1961 | Lubash | 229/44 CB X |
| 3,207,416 | 9/1965 | Koltz et al. | 229/44 CB |
| 3,583,625 | 6/1971 | Gero et al. | 229/44 CB X |
| 3,752,307 | 8/1973 | German | 206/92 |
| 3,915,295 | 10/1975 | Morrison | 206/92 X |

*Primary Examiner*—Davis T. Moorhead
*Attorney, Agent, or Firm*—Joseph Hirschmann

[57] ABSTRACT

The invention relates to a cigarette box or package in which a three-sided insert is provided at the top of the box which is cut away on the three sides in such manner that the tops of the cigarettes can be seized between the finger and thumb from any two of three directions for removal, thereby preventing mutilation. The lid or cover of the box is hinged to one of the narrower sides of the box and in such manner that it can be tilted to open position with the thumb of one hand while held in such hand, to expose the cutouts in the insert adjacent to the opposite narrower wall, so that the finger and thumb of the other hand can easily remove a cigarette. In one form of the invention, the box is rhomboidal in shape and a pair of diagonally opposite corners are rounded off to provide greater convenience and comfort in holding the box. The tops of the insert sides have a more or less central riser section flanked by depressed sections, and are preferably in the form of sinuous curves, with a concave section followed by a convex section, the concave sections on the opposite sides of the insert providing two of the directions from which the cigarettes can be grasped, the third cutout being at the top of the narrower wall of the insert. In a further development of the invention, there is provided a compartment for receiving a book of matches which is secured to the bottom of the box and which is covered by a first flap having a layer of friction material on the outside thereof and which in turn is covered by a second flap which conceals the friction layer, thereby providing greater safety as a match is struck after lifting the second flap, the rest of the matchbook being then covered by the first flap. The closure and body of the box preferably meet along a line which is parallel to the top and bottom of the box when the box is of rhomboidal shape. In all forms of the invention, the top edges of the insert lie in a plane which is a substantial distance above the top of the shell or body of the box and is approximately parallel to the inside bottom wall of the box, so that the top edges of all of the cigarettes lie in such plane or slightly above it; while at its low point near the hinge of the closure, the convex portion of the front and rear walls of the insert also allows a cigarette to be grasped and withdrawn.

17 Claims, 10 Drawing Figures

CIGARETTE BOX OR PACKAGE

The present invention relates to boxes or cartons for packaging cigarettes.

According to the invention, there is provided a cardboard closure whose blank is formed integrally with the blank for forming the body and bottom of the box, the box being provided with a three-sided adhesively secured insert projecting above the edges of the walls of the box, the middle, or end wall of the insert and adjacent portions of the side walls extending laterally therefrom being provided with cutouts opposite the end wall of the box to which the closure is hinged, and in such manner that cigarettes projecting above the the upper edges of the insert can be seized a distance from their tops and from any two of three directions, so that removal of a cigarette from even a tightly packed box of cigarettes can be accomplished by the thumb and forefinger of the hand without danger of tearing or mangling the top of the cigarette.

The invention also provides a compartment at the bottom of the box and formed of walls or panels integral with the blank from which the body of the box is formed, such compartment receiving and concealing a number of matches, preferably a book of paper matches. The individual matches of the book of matches are removable on opening the bottom of the box which is hinged to an end wall of the box, whereupon there is revealed a flap having upon its upper face a friction surface, such flap and box bottom being normally tucked under an overhanging portion of the inwardly folded extension of the opposite end wall of the box, or of a panel forming such end wall, disengagement and outfolding of the box bottom and flap exposing the matches for removal of individual matches.

In the preferred form of the invention, the combined box and closure are of rhomboidal shape, the top of the cover and the bottom of the box being parallel to each other, but extend at an angle to the end walls of the box. The opposite corners of the assembled box and closure at the shorter diagonal are rounded in shape for greater comfort and convenience when the box is held in the palm of the hand.

The closure is provided internally thereof with a cardboard baffle plate which prevents the still contained cigarettes, after removal of some of them, from sliding upwardly from the box.

The cutouts are preferably formed by providing the front and rear panels of the insert with edges in the shape of a sinusoidal-like or re-entrant curve with the concave part of the curves adjacent to the end wall of the insert remote from the hinge of the insert, the cutout in the end wall of the insert being so formed that angular vertical reinforcing posts are located at the corners of the insert. The convex part of the upper edges of the insert are turned downwardly toward the hinge of the closure and above the box wall edges, leaving a space near the hinge open at the front and rear walls of the box body from which a cigarette can, if desired, be removed.

In the accompanying drawings forming part of this specification:

FIG. 9 is a plan view of the blank employed for constructing the cigarette box and closure with an integral match compartment; while FIG. 10 shows in full a part of the blank illustrated in FIG. 9.

Figure 1:
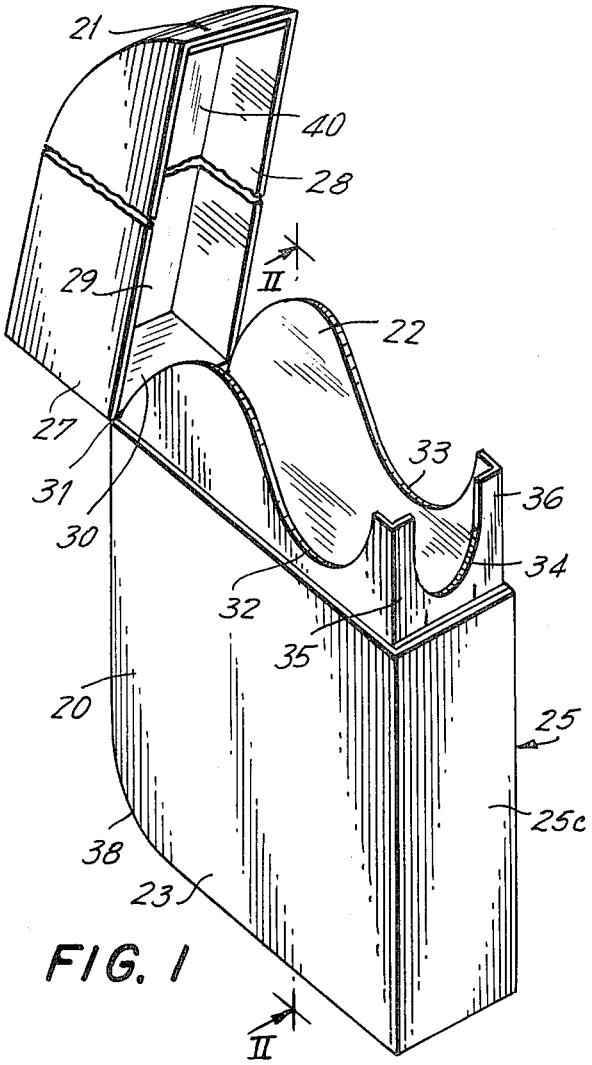
FIG. 1 is a perspective external view of a preferred form of cigarette box and integral closure constructed according to the invention.

Referring to the drawing, and particularly to the preferred form of the invention shown in FIGS. 1 to 4, the box is composed of a body 20 and a hinged closure 21, while a three-sided insert 22 projects above the upper edges of the box body 20 and is received within the closure 21 when the latter is in the closed condition. The box is composed of opposite wider front and rear walls 23, 24, and narrower side walls 25,26. The closure is similarly composed of wider walls 27,28, and narrower walls 29,30, the wall 30 being integral with the narrow wall 26, or the outside panel forming the same, as will be explained more fully hereinafter. The closure is hinged to wall 26, as indicated at 31.

The insert 22 is adhesively secured within the inner faces of the walls 23,24 and 25 of the body of the box, and is provided at the end thereof opposite the hinge 31 with cutouts 32 and 33 in the wider walls thereof, and with the cutout 34 in the adjacent narrow end wall. These cutouts are so formed that angular sections or posts 35 and 36 are provided which strengthen the insert while allowing cigarettes projecting into the insert to be seized from any two of three directions, allowing a sufficient length of the cigarettes to be exposed to prevent tearing or mangling of a cigarette being removed even from a full pack.

In the form of the invention illustrated in FIGS. 1 to 4, the box with the closure in closed condition is in the form of a rhomboid. The corners 37 and 38 at the ends of the shorter diagonal of the combined closure and body are rounded so as to provide greater convenience and comfort when the box is held in the palm of the hand, especially when downward pressure is applied by the thumb of such hand against the upper corner 39 of the closure to flip open the closure. As will be evident from FIG. 2, greater leverage is provided to facilitate the opening of the closure because the top corner 39 is a considerable distance above the hinge 31 of the closure, the distance being about 1 inch.

To prevent the cigarettes from sliding into the closure 21, there is provided a baffle plate 40 within the closure having downward extensions 41 and 42 which are adhesively secured to the walls 29 and 30 of the closure.

In the preferred form of my invention, and as described in detail in connection with FIG. 9, I provide at the bottom of the box a compartment for the storage of a book of paper matches which are out of contact with the cigarettes, and there are provided also two extensions or flaps at the bottom of two panels forming the narrow wall 25 of the box, an inner panel extension being coated on its outer surface with a friction material, while the other, outer extension or flap forms the outside bottom of the box, and preferably along with the first extension, is tucked under a folded-in section or extension of the opposite narrow wall of the box, to which extension the book of matches is secured, as by stapling, as will shortly be detailed.

Figure 4:
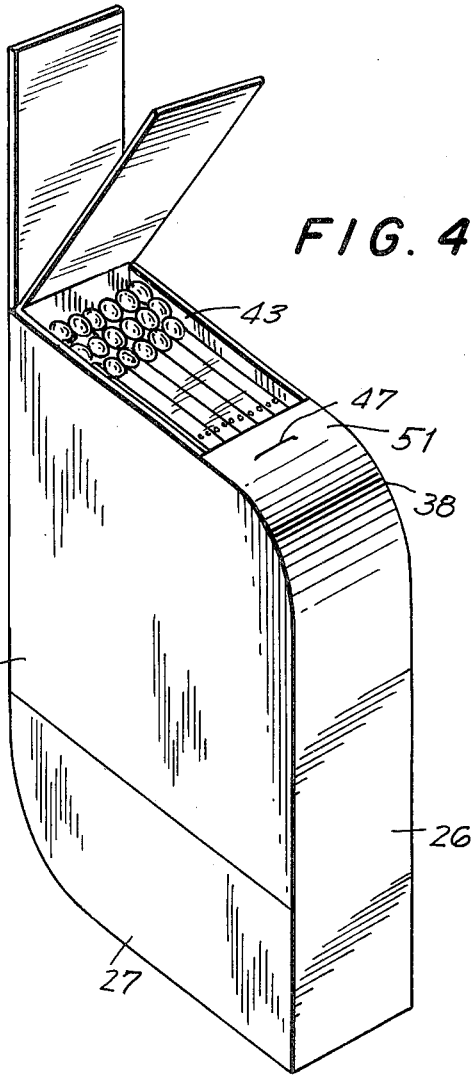
FIG. 4 is a perspective view illustrating the compartment for a book of matches and the two cover flaps at the bottom of the cigarette box.
Figure 2:
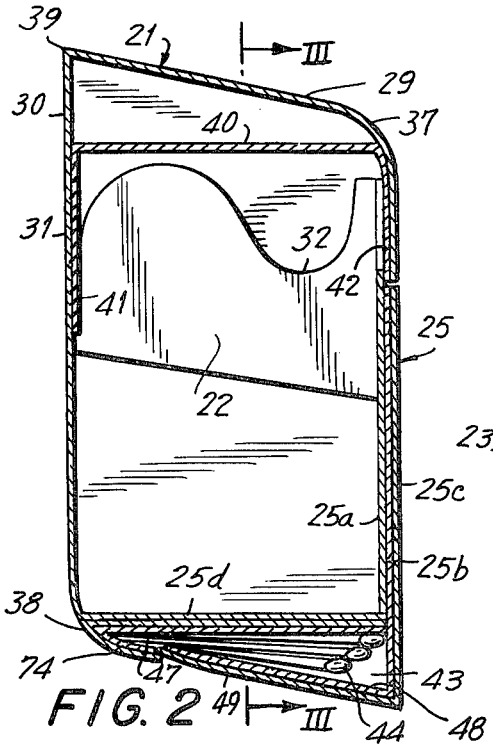
FIG. 2 is a vertical section along line II — II of FIG. 1.
Figure 3:
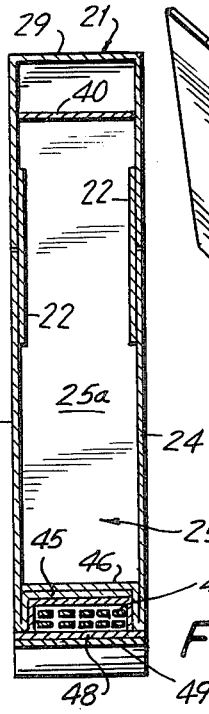
FIG. 3 is a transverse vertical section along the line III—III of FIG. 2.

As seen best in FIGS. 2 and 4, the narrow wall 25 is composed of three panels, the inner panel 25*a*, the middle panel 25*b*, and an outer panel 25*c*. The panel 25*a* is an extension of insert 22 (see also FIG. 8) and provides the inside narrow wall surface of the box, as already stated.

The inside bottom 25*d* of the box is formed of two angled extensions 45,46 of walls 23,24, serving to strengthen the box in such region, and at the same time serve as a safety guard separating the matches from the cigarettes. They folded on themselves, as described in detail in connection with FIG. 9, as to provide a compartment 43 for receiving a book of matches 44 which is secured, as by a staple 47, to a folded extension 51 of the wall 26.

Figure 5:
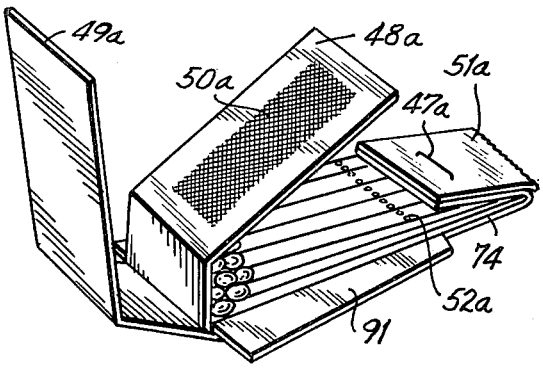
FIG. 5 illustrates the manner of constructing the match holder separately of the box for subsequent adhesively securing it to the bottom of the box.

The panels 25*b* and 25*c* are provided with extensions 48,49. The inner extension 48 is provided on its outer surface with a friction material 50, and the extensions 48 and 49 are of such length that they can be tucked under the extension 51 of the opposite narrow wall, and conceal the book of matches, the extension 49 at the same time covering the friction surface. The book of matches may be provided with scoring or perforations 52, as indicated in FIG. 5, to facilitate the tearing away of a match.

To reduce the height of the compartment 43, the matches are preferably arranged with the pyrophoric heads of groups of matches out of vertical alignment, as shown in FIG. 2.

The top edges of the insert 22 in FIGS. 1 and 2 are approximately sinusoidal, with the concave portions adjacent to the posts 35 and 36, while the convex sections allow cigarettes to be seized adjacent to the hinge 31.

Figure 6:
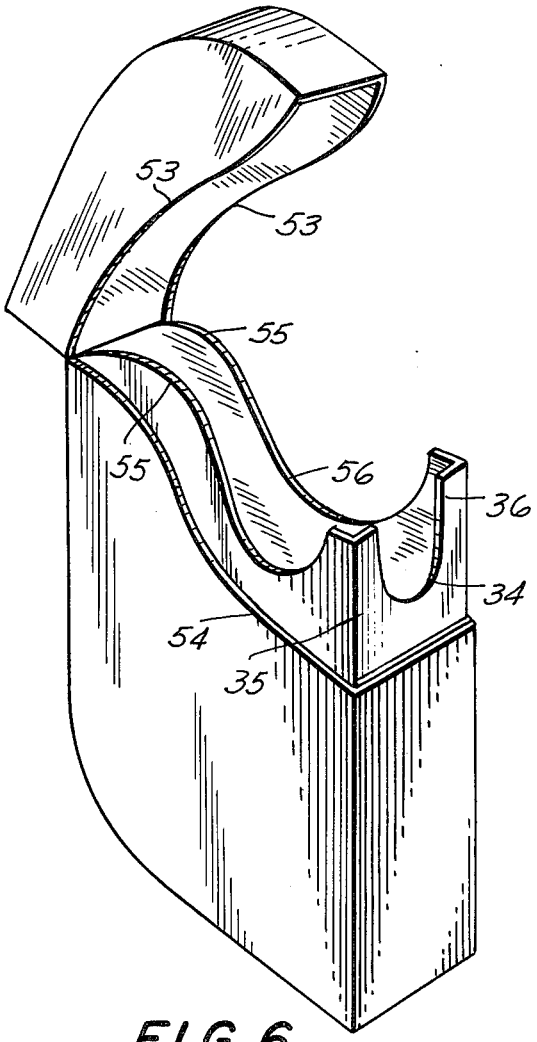
FIG. 6 is a perspective view of a modified form of the invention having curved meeting edges of the box body and its closure.

In the rhomboidal form of the invention illustrated in FIGS. 1 to 4, the line of engagement of the top of the body of the box the bottom of the closure is straight and parallel to the bottom of the box and top of the closure. In the form of the invention shown in FIG. 6, the line of engagement is curved, as shown at 53 and 54, the outline of the closed box being again rhomboidal. In the construction of FIG. 6, the curved upper edge of the insert is not nearly sinusoidal, as in FIGS. 1 and 2, the convex portion 55 of the upper edges of the insert being shaped on a larger radius than the portion 56—56.

Figure 7:
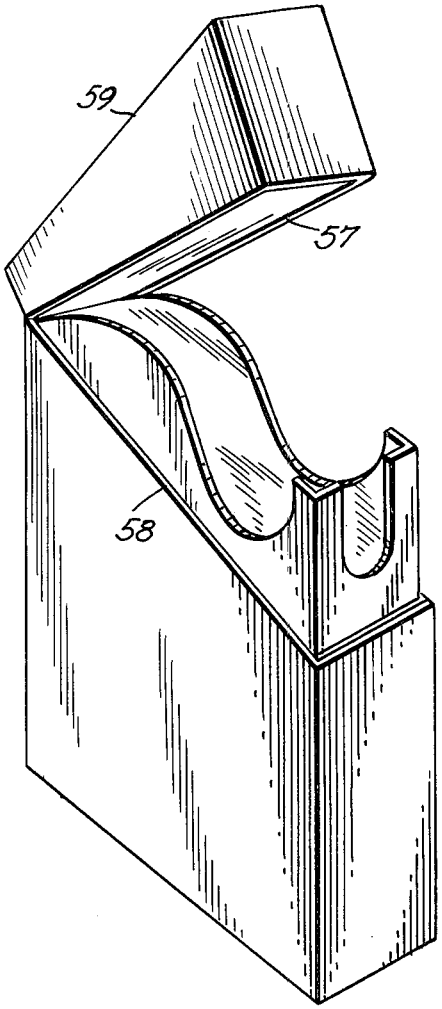
FIG. 7 shows a box of parallelepiped shape.

In the form of the invention shown in FIG. 7, the box, with the closure in closed condition, is of the familiar parallelepiped shape, but the lines of contact between the bottom edges 57 of the closure and the top edges 58 of the body of the box are straight lines which are at angle to the top of the closure and bottom of the box, it being understood that this form of the invention as well as that of FIG. 6, may be provided with the match compartment and extensions similarly to FIGS. 1 to 4.

Figure 8:
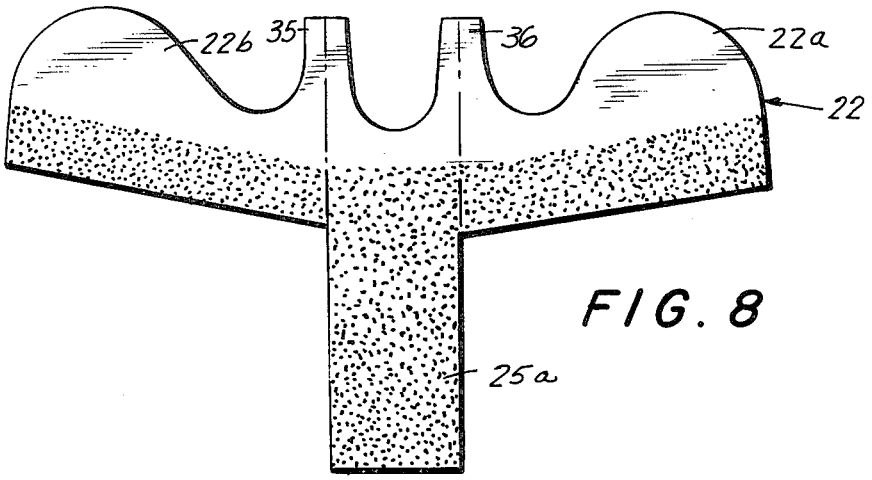
FIG. 8 is a plan view of the insert blank corresponding to the insert shown in FIG. 1.

FIG. 8 illustrates the blank for the insert 22 and the manner of providing the insert with glue or other adhesive prior to assembly within the body of the box.

Figures 9, 10:
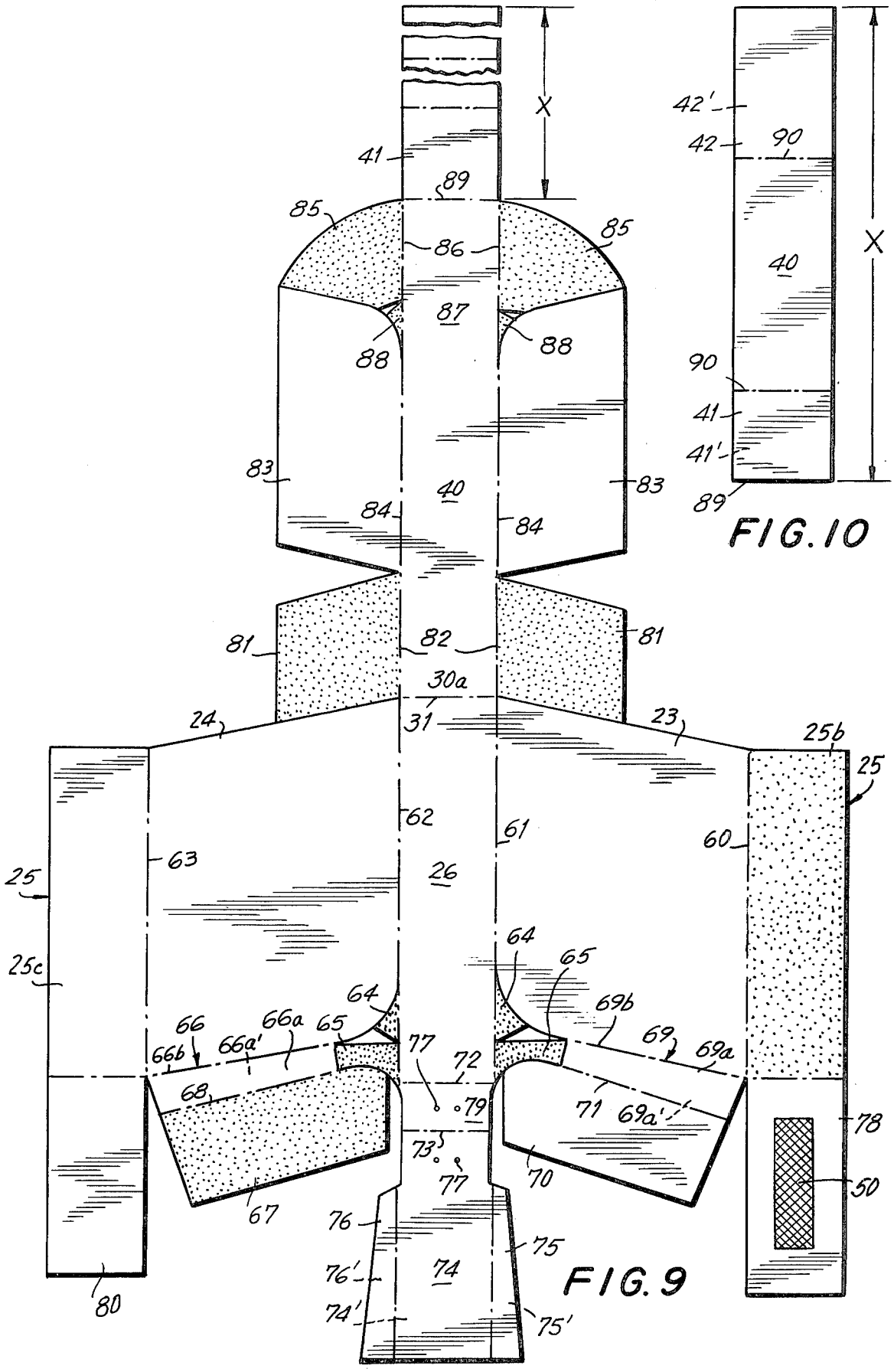

The integral blank providing the different parts of the body of the box and its closure is shown in FIG. 9, and is formed of a stamping of cardboard or the like, the adhesively coated surfaces being indicated by stippling. Certain of the opposite surfaces of the illustrated blank are likewise adhesively coated and are indicated by a numeral with a prime symbol ( ′ ) attached.

Parts of the blank of FIG. 9 which are visible in FIGS. 1 to 4 are similarly numbered, and fold lines are indicated by dot-and-dash lines.

The body of the box composed of the wide panels 23 and 24 and the narrow panels 25, 26, these constituting the shell, is erected by folding the panels along the fold lines 60, 61, 62 and 63, the panel 25*c* overlapping panel 25*b* which is provided with adhesive, as indicated in FIG. 9, thus forming narrow end wall 25, while the panel 26 constitutes the other end wall of the box body.

The erection of the rectangular shell of the box body is completed by the adhesion of panel 25*a* of the insert (FIG. 8) to the inside surface of panel 25*b*.

Attached to the bottom of the panel 26 are opposite pairs of fillets 64 and 65 which serve to accommodate the curved corners of the panels 23 and 24, and are adhesively coated for attachment to panels 23,24.

At the bottom of panel 24 is an extension 66 having an adhesively coated section 67 and an uncoated section 66a adapted to be folded against panel 24 along the lines 68 and 66*b*. A similar extension 69 extends from the bottom of panel 23 and terminates in a portion 70 and includes portion 69*a* by a fold line 71. The portions 66*a* and 69*a* of extensions 66,69, that is, the smaller portions thereof, are designed to be folded against the respective panels 24 and 23 along fold lines 66*b*, 68 and 69*b*, 71, with the larger sections 67 and 70 extending horizontally to constitute the bottom wall of the box on which the cigarettes will rest. The sections 67 and 70 are secured to each other by the layer of adhesive on the upper surface of the section 67.

The end panel 26 is separated by spaced fold lines 72 and 73 from an extension 74 having a side flaps 75 and 76, and dimensioned to form the match compartment. To form such compartment, and after extensions 67 and 70 have been secured in the horizontal position, the intermediate section 79 is folded along fold line 72 against the bottom portion of panel 26, and such folded portion then bent to conform to curve 38 (FIG. 2) after being stapled at 47 with the matchbook to panel extension 74, which is now horizontal. (The staple holes are indicated at 77 in FIG. 9 merely to show the location of the staples). The panel 26 is held in curved condition by the adhesive layers on fillets 64 and 65 and the reverse sides of flaps 75, 76, as viewed in FIG. 9, which now lie against portions 69*a* and 66*a*. The book of matches may be secured to this folded back extension by way of the stapling 47 (FIG. 5) before or after the panels 23, 24, 25*c*, 25*b* and 26*a* have been erected, and the parts 67 and 70 have been adhesively secured to each other. The adhesive on underside 74′ of extension 74 secures the latter to extension 70. The portion of the wall 26 above the hinge 31 is indicated at 30a. Attached to such portion are adhesively coated wings 81 which are folded along fold lines 82 and fitted within the folded flaps 83 of the top wall 40 of the closure when the latter are folded along lines 84 to bring them at right angles to the top wall 40.

Attached to the extension 40 of wall 26 are adhesively coated flaps 85 which are foldable around the lines 86 and upon erection of the flaps 83 are moved inside such flaps and secured thereto.

The portion 87 of the extension 40 fits around the outer free edges of flaps 83 as viewed in FIG. 9 and conforms to the curved thereof. The fillets 88 are adhesively coated and become attached to the flaps 83 at the curves thereof to form a continuous line of contact between the part 87 and the curved edges of the flaps 83.

The extension 41 is folded along the line 89 and its end portion 42, which is adhesively coated on its reverse side 42', as viewed in FIG. 9, is folded along the line 90 and is secured to the inside of the wall 30 in such manner that the portion 40 is so positioned that it serves as a baffle, as indicated at 40 in FIG. 2, to prevent rise of the cigarettes in the box. Portion 42 gives additional strength to parts 31*a* and 31 which move each time the box is opened and closed, and hence are subject to considerable wear.

The compartment for storing and concealing the book of matches can be constructed separately of the body of the cigarette box and subsequently adhesively secured to the bottom of the box. This is shown in FIG. 5 wherein parts corresponding to parts shown in FIGS. 1 to 4 and 9 bear the same numerals but with the letter *a* attached. At 91 are shown side flaps which are bent upwardly to close the sides of the compartment, and the whole, in inverted position will be received within the bottom of the shell or body.

It will be noted that upon raising of the closure 21, there will immediately be exposed a considerable length of a number of cigarettes through the cutouts 32, 33 and 34. One or more cigarettes can then be removed without tearing their upper edges, as will be readily understood from FIGS. 1, 2, 6 and 7. This is due to the fact that the height of the insert above the walls 23, 24, and 25 is substantially uniform and parallel to the bottom of the box; i.e., the tops of the posts 35, 36 and of the convex sections 55 lie in, or approximately in, a plane parallel to the plane of the inside bottom wall of the box, the topmost portions of the insert being a substantial distance, of the order of three-fourths inch, above the upper edges of the walls 23, 24 and 25.

I claim:

1. A cigarette box having opposite pairs of wider and narrower walls, and having at its top a three-sided insert projecting above one of the narrower and adjacent wider walls of the box and comprising a relatively narrow end wall and front and rear walls extending laterally therefrom, said end wall and the laterally extending front and rear walls of the insert provided with open cutouts therein separated by corner sections, said insert being disposed within and extending below the upper edges of the said one narrower and side walls of the box the box having a closure hinged to the opposite narrow wall of the box, whereby upon opening of the closure, the insert and its cutouts are exposed and enable the cigarettes to be removed by being gripped wth the aid of thumb and finger pressure from any two of three directions and mangling of the tops of the cigarettes thereby avoided.

2. A cigarette box having a body comprising oppositely disposed pairs of wider and narrower walls and having a closure with a wall hinged on one of the narrow walls, an insert at the top of the body projecting above the top edges of the body, the wider walls of the insert having adjacent to the narrow body wall opposite the closure hinge, opposed cutouts therein exposing the tops of cigarettes visible through such cutouts when the closure is raised to facilitate grasping of the tops of the cigarettes, the hinged wall of the closure being of such height as to enable the closure to be flipped open with the thumb as the box is held in the palm of one hand, thereby enabling the cigarettes to be seized between the thumb and forefinger of the other hand and across said opposed cutouts.

3. A cigarette box as defined in claim 2, wherein the insert is composed of three walls overlapping the side walls of the box and its end wall opposite the hinge of the closure and is provided with three cutouts in such walls at the end thereof opposite the hinged end of the closure separated by two corner sections forming reinforcing posts separated by two corner sections forming reinforcing parts.

4. A cigarette box having a body comprising oppositely disposed pairs of wider and narrower walls and having a closure with a wall hinged on one of the narrow walls, an insert composed of three walls at the top of the body projecting above the top edges of the body, the insert having adjacent to the narrow body wall opposite the closure hinge, cutouts in each of its walls exposing the tops of cigarettes visible through such cutouts when the closure is raised to facilitate grasping the tops of the cigarettes, the hinged wall of the closure being of such height as to enable the cover to be flipped open with the thumb as the box is held in the palm of one hand, thereby enabling the cigarettes to be seized between the thumb and forefinger of the other hand, the top edges of the side walls of the insert being in the form of sinuous curves composed of concave and convex sections, the concave sections providing two of the aforementioned cutouts.

5. A cigarette box having a body comprising oppositely disposed pairs of wider and narrower walls and having a closure with a wall hinged on one of the narrow walls, an insert at the top of the body projecting above the top edges of the body, the wider walls of the insert having adjacent to the narrow body wall opposite the closure hinge, opposed cutouts therein exposing the tops of cigarettes visible through such cutouts when the closure is raised to facilitate grasping of the tops of the cigarettes, the hinged wall of the closure being of such height as to enable the closure to be flipped open with the thumb as the box is held in the palm of one hand, thereby enabling the cigarettes to be seized between the thumb and forefinger of the other hand and across said opposed cutouts, the box with its closure thereon being rhomboidal in shape, the two diagonally opposite obtuse-angled corners thereof being curved for greater comfort while the box is resting in the palm of the hand.

6. A cigarette box as defined in claim 2, wherein the closure of the box is formed of four walls and a top, and dimensioned to receive the exposed portion of the insert, the bottom edges of the opposing wider walls of the closure making an acute angle with the side walls, one end wall of the closure being lower in height than the other, the end of greater height being hinged to the corresponding narrow wall of the box by upward pressure, whereby greater leverage is afforded for opening the box by upward pressure with the thumb while the box is held in the palm of a hand.

7. A cigarette box as defined in claim 2, wherein the closure of the box is formed of four walls and a top, and dimensioned to receive the exposed portion of the insert, the bottom edges of the opposing wider walls of the closure making an acute angle with the side walls, one end wall of the closure making an acute angle with the side walls, one end wall of the closure being lower in height than the other, the end of greater height beng hinged to the corresponding narrow wall of the box, whereby greater leverage is afforded for opening the box by upward pressure with the thumb while the box is held in the palm of a hand, the box with its closure thereon being of rhomboidal shape, and the top wall of the closure and the bottom wall of the body of the box being parallel to each other and forming an acute angle to the narrower side walls of the box, the line engagement of the closure with the box and outside the insert being parallel to the top wall of the closure.

8. A cigarette box having opposite wider and narrower walls and a closure hinged at the top of one of the narrower walls and integral therewith, the narrow wall opposite the hinge being formed of a plurality of panels, two of which have extensions fitting under a bottom extension of the opposite narrow wall, said last-mentioned extension being bent inwardly for a short distance at the bottom of the box and having attached to the inner face thereof a book of matches, the inner of the two panel extensions of the said narrow wall being provided with a friction surface on its outer face and the other of said two extensions serving as a cover for the friction surface when the two extensions are inserted under the extension of the opposite narrow wall.

9. A cigarette box having opposite pairs of wider and narrower walls, and having at its top a three-sided insert projecting above one of the narrower and adjacent wider walls and comprising a relatively narrow end wall and front and rear walls extending laterally therefrom, said end wall and the laterally extending front and rear walls of the insert provided with cutouts therein separated by corner sections, the box having a closure hinged to the opposite narrow wall of the box, whereby upon opening of the closure, the insert and its cutouts are exposed and enable the cigarettes to be removed by being gripped with the aid of thumb and finger pressure from any two of three directions and mangling of the tops of the cigarettes thereby avoided, the narrow wall of the body of the box beneath the cutout in the narrow wall of the insert being composed of two panels, each of which has an extension folded to form the bottom of the box, the opposite narrow wall of the box having an extension which is folded toward the bottom of the box for a short distance, a book of matches secured to the inside face of such extension, but at a distance from the face edge thereof, the inner extension of the opposite narrow wall of the box being provided with a friction surface, and the extension of the outer panel of such narrower wall serving to cover and conceal the inner extension when both extensions are tucked under the end of the third-mentioned extension to conceal the book of matches.

10. A cigarette box, as defined in claim 9, wherein the box is provided with an inner bottom wall disposed above the book of matches and separating the matches from the cigarettes.

11. A cigarette box, as defined in claim 5, wherein the closure is provided with a barrier wall to keep the cigarettes from entering the upper region of the closure.

12. A cigarette box provided with a match compartment at its bottom, said compartment opening toward the bottom of the box and containing a book of flexible matches, said book being overlaid by two hinged flaps, the inner one of which is provided with a friction surface facing toward the bottom of the box, while the other overlies and conceals the inner flap and the book of matches and provides the bottom of the box.

13. A carboard blank for the manufacture of a cigarette box comprising sections constituting opposite wider and narrower walls of the body of the box, an integral closure section adapted to be hinged on one of the narrower walls and likewise comprising opposite wider and narrower walls, and integral sections foldable into a compartment at the bottom of the box for housing and concealing a group of matches, the compartment opening toward the bottom of the box, and an integral flap constituting the bottom wall of the box and serving to close the compartment.

14. A carboard blank according to claim 13, wherein the last-mentioned sections including an extension of one end wall panel of the box having flaps for securement to the opposite wider walls of the box, the opposite end wall of the box being comprised of two panels having bottom extensions of which the inner one has a friction coating on its outer surface while the other is foldable to overlie the friction surface and constitute the bottom of the box.

15. A cardboard blank as defined in claim 13, wherein one of the side walls of the body of the blank is provided with an extension which overlaps the bottom of the box in its assembled condition, and above which a book of matches is to be received and stapled to the inside face thereof at a distance from its free end, one of the panels to form part of the opposite end wall of the assembled box body being provided with an extension fitting over the assembled book of matches and fitting under the first mentioned extension and serving to conceal the matches.

16. A blank according to claim 15, wherein the second-mentioned extension is provided with a friction surface upon the outer face thereof, a further narrow panel of the blank providing the outer surface of the said one side wall of the assembled box, and including a third extension of a length approximately equal to that of the aforementioned second extension and overlying said second extension, said second and third extensions being dimensioned to fit under the first-mentioned extension in the assembled condition of the body of the box, said third extension providing the bottom surface of the assembled box.

17. A cigarette box as defined in claim 4, wherein the upper edges of the wide side walls of the box and likewise the bottom edges of the wide side walls of the closure are similarly of approximately sinusoidal shape, so as better to resist endwise crushing pressures.

* * * * *